343-909 SR
2/16/88 XR 4,725,848

United States Patent [19]
Honda

[11] Patent Number: 4,725,848
[45] Date of Patent: Feb. 16, 1988

[54] CONSTANT BEAMWIDTH SPIRAL ANTENNA

[75] Inventor: Royden M. Honda, San Jose, Calif.

[73] Assignee: Argo Systems, Inc., Sunnyvale, Calif.

[21] Appl. No.: 718,465

[22] Filed: Apr. 1, 1985

[51] Int. Cl.[4] ..... H01Q 1/36
[52] U.S. Cl. ..... 343/895; 343/909
[58] Field of Search ..... 343/895, 754, 725, 893, 343/868, 909

[56] References Cited

U.S. PATENT DOCUMENTS

| | | | |
|---|---|---|---|
| 3,562,756 | 2/1971 | Kuo et al. | 343/895 |
| 3,681,772 | 8/1972 | Ingerson | 343/895 |
| 3,956,752 | 5/1976 | Phelan et al. | 343/895 X |
| 4,243,993 | 1/1981 | Lamberty et al. | 343/895 |
| 4,525,720 | 6/1985 | Corzine et al. | 343/895 |
| 4,559,539 | 12/1985 | Markowitz et al. | 343/895 |
| 4,605,934 | 8/1986 | Andrews | 343/895 |
| 4,608,572 | 8/1986 | Blakney et al. | 343/895 |

OTHER PUBLICATIONS

"Microwave Filters, Impedance-Matching Networks, & Coupling Structures", Matthaei et al., 1964, pp. 365-374.

*Primary Examiner*—Daniel M. Yasich
*Attorney, Agent, or Firm*—Flehr, Hohbach, Test, Albritton & Herbert

[57] ABSTRACT

A planar two-arm Archimedean spiral antenna has a design of semi-lumped element circuit incorporated in each arm to form serial-inductance, shunt-capacitance, ladder-type Tchebyscheff low pass filters. Energy travelling outward from the center is mostly radiated when a ring of a certain size is reached and whatever remaining unradiated energy is attenuated without giving rise to undesired higher order radiation.

8 Claims, 4 Drawing Figures

CONSTANT BEAMWIDTH SPIRAL ANTENNA

BACKGROUND OF THE INVENTION

This invention relates to a spiral antenna with constant beamwidth over an extended frequency range and in particular to a center-fed two-arm spiral antenna with its arms incorporating a design of semi-lumped element to form low pass filters which attenuate undesired excess currents.

Spiral antennas have been in use extensively as electromagnetic radiator and various geometries have been investigated, including square, hyperbolic and elliptic. Archimedian and equiangular (or logarithmic) spiral antennas, however, seem to be the most commonly used; the equiangular spiral is used in both planar and conical configurations, while the Archimedean is primarily used in the planar configuration.

Multi-arm spiral antennas have also been investigated for generating sum and difference patterns by choosing appropriate phase relationships among the arms. Even though the spiral is inherently circularly polarized in one sense only, such as the right-hand circular or the left-hand circular depending on whether the spiral antenna arms are wound in clockwise or counter-clockwise direction, experiments have been conducted to achieve both senses of circular polarization from a single spiral. A multi-arm spiral antenna for operation with dual senses of circular polarization was disclosed in Ingerson, U.S. Pat. No. 3,681,772 with arms having log-periodically scaled width variations to produce local reflection regions. A method of using choke elements that resonate at predetermined frequencies to eliminate or minimize undesired radiation was disclosed in Lamberty et al., U.S. Pat. No. 4,243,993. Performance of center-fed two-arm spirals, however, has remained unchanged over a long period of time. The two-arm spiral antennas are used individually, in monopulse direction finding system made of several spirals, or as array elements. In general, the individual spiral antenna pattern is of primary concern in each of these cases.

The spiral antenna is a very broadband device, but it is not truly frequency-independent because the radiation pattern varies with frequency when the antenna is designed to cover a multi-octave frequency bandwidth. This variation is attributable to the conclusion by the band radiation theory that current flowing outward from the center of the spiral is radiated when the current reaches a band or a ring having circumference equivalent to one wavelength. The unradiated current continues to flow outward until another ring of proper diameter is reached, at which point radiation takes place again. This secondary radiation interferes with the primary radiation, thus causing variations in the pattern beamwidths.

It is therefore an object of this invention to provide a broadband two-arm spiral antenna with constant beamwidth over unlimited bandwidths.

It is another object of this invention to provide a two-arm center-fed Archimedean spiral antenna which eliminates undesired radiation characteristics such as secondary radiation.

It is a further object of this invention to provide a two-arm Archimedean spiral antenna with its arms forming low pass filters which attenuate the excess currents that flow beyond the primary radiation ring of the band radiation theory.

These and other objects are achieved in accordance with this invention by a center-fed two-arm Archimedean spiral antenna with each arm designed with abrupt width variations such that normal-width sections and reduced width sections occur alternately along its length. The lengths of these sections are determined by a known method of designing Tchebyscheff serial-L shunt-C, ladder low pass filters using semi-lumped elements.

DETAILED DESCRIPTION OF THE INVENTION

Figure 1:
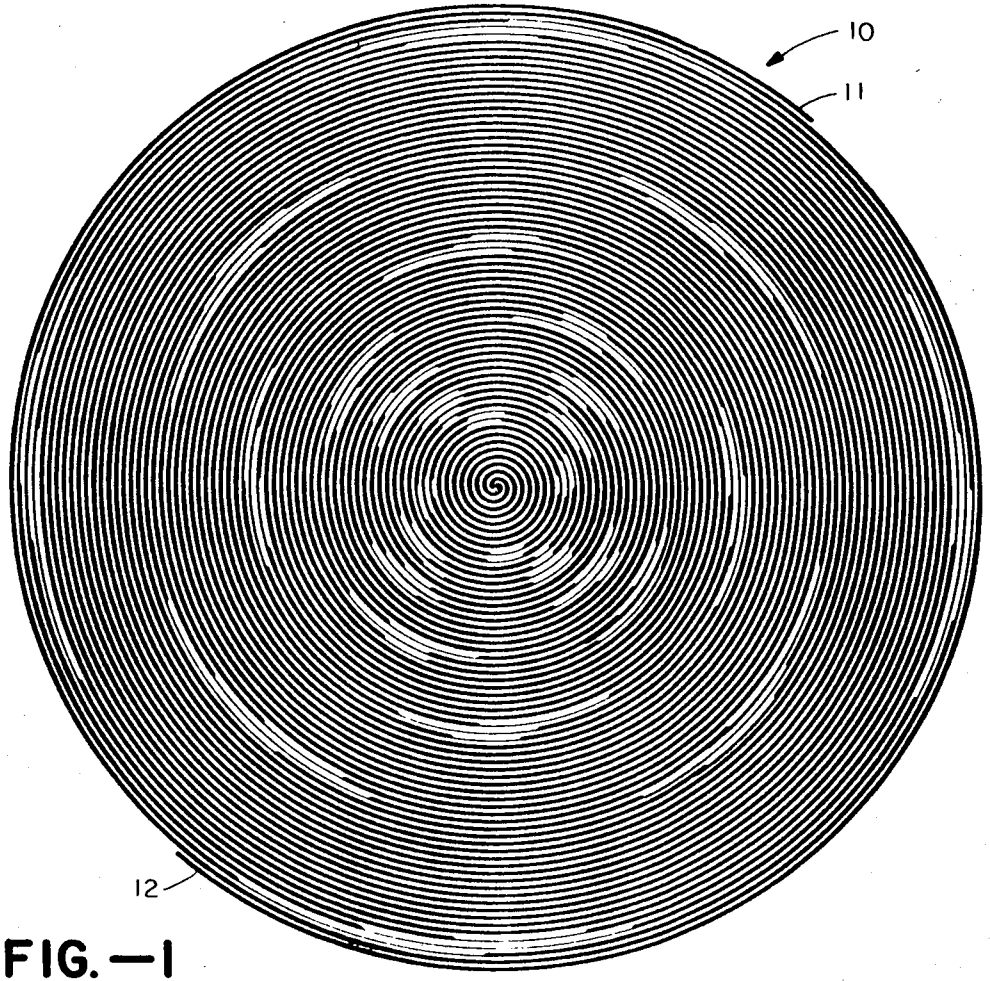
FIG. 1 depicts a two-arm Archimedean spiral antenna configured in accordance with this invention.

FIG. 1 depicts an embodiment of the present invention according to which a center-fed planar Archimedean spiral antenna 10 has two arms 11 and 12 which spiral outwardly from a feedpoint in the center. The two arms are identical in design and disposed symmetrically with respect to an axis at the center and normal to the plane of the antenna. Each arm is an electrically conductive strip of a uniform width with specified sections along its spiraling length having a reduced width. The boundaries of these reduced-width sections are sharply defined. The distance between the feedpoint and the innermost of such boundaries along the spiraling length of the arm is denoted by $l_1$ herein. The distance between the nth and (n+1)st boundaries, measured likewise along each arm, will be denoted by $l_{n+1}$ where n is an integer. Such reduced-width sections and normal-width sections appear alternately as one follows each arm from the center, $l_n$ will denote the length of a normal-width section if n is odd, and of a reduced-width section if n is even. In what follows, a polar coordinate system with its origin at the center of the spirals will also be used concurrently. The angular coordinate of the nth boundary (between a normal-width section and an adjacent reduced-width section) as defined above will be denoted by $\phi_n$. If the equation of the arm is given in this polar coordinate system, $l_n$ can be written as a function of $\phi_{n-1}$ and $\phi_n$ by a well-known method of integral calculus.

As shown in FIG. 1, each arm of the antenna in the innermost region is a continuous ribbon-like conductor of uniform widths so that the antenna in this region does not look differently from a small conventional spiral antenna. Energy travels outward from the feedpoint, with the spiral arms acting as transmission lines. When it first reaches an annular region of the antenna where the current flowing in the adjacent arms are substantially in phase with respect to each other, most of the energy is radiated away. Since the two arms share a common feedpoint, this annular region will be identified by its circumference of one wavelength. The radiation efficiency, however, is not 100% and the portion of energy not radiated away continues to flow outward until another radiation-causing annular region is reached. The purpose of the reduced-width sections in the arms is to provide a low pass filter means so that frequencies lower than a pass band edge will flow virtually unhindered out towards their respective radiation rings since the primary radiation ring size is inversely proportional to frequency. The filter means must be so designed that the primary radiation for frequencies above the band edge frequency should take place before the energy encounters the filter sections. Whatever unradiated energy still remaining is thus attenuated and will not give rise to undesired high order radiation or pattern degradation.

Figure 2:
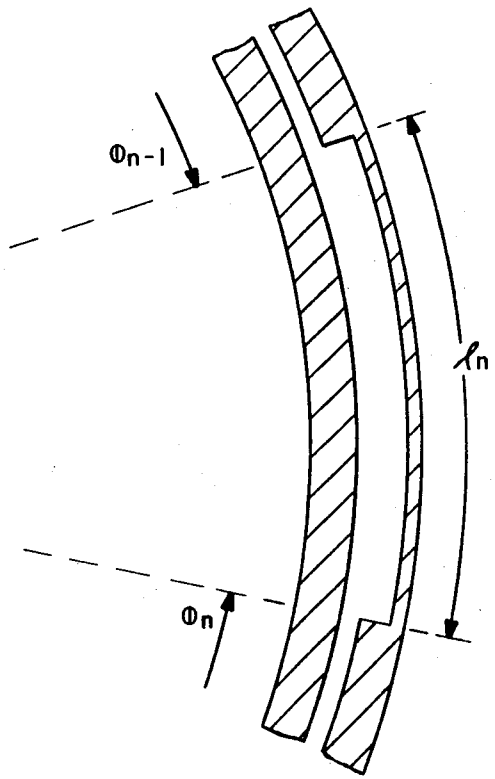
FIG. 2 shows schematically and in enlarged form a portion of the antenna of FIG. 1, including step discontinuities in spiral arms.

The antenna is designed to make use of the so-called "equal ripple" attenuation characteristics of a Tchebyscheff low pass filter because it is known to give a sharp rate of cutoff. As shown in FIG. 2, which shows schematically in an enlarged form a portion of the antenna of FIG. 1 at a step discontinuity, the arms of the antenna of FIG. 1 approximate a series-L, shunt-C, low pass filter.

The use of short lengths of transmission lines that act as semi-lumped elements is an effective means of designing equal ripple Tchebyscheff filter characteristics and tables of values needed for designing such filters are available in "Microwave Filters, Impedance-Matching Networks and Coupling Structures" by Matthaei, Young and Jones (McGraw-Hill Book Company, San Francisco 1964). The lengths $l_n$ defined above are given by a series of simultaneous equations on pages 369 and 370 of the aforementioned reference. If correction terms are neglected and the fringing capacitance at the junctions is assumed small, however, they can be simplified as follows:

$$l_n=(V_h/\omega_i)\sin^{-1}(Zg_n/Z_h)$$

if n is odd, $$l_n=(Vg_n/\omega_i)$$

if n is even, where the symbols are as used in the aforementioned reference, that is, $Z_l$ and $Z_h$ represent the alternate sections of low impedance and high impedance in the semi-lumped realization of the filter, $V_l$ and $V_h$ are velocities of propagation along the low and high impedance lines, $\omega_i$ is the angular band edge frequency and $g_n$ are values tabulated in the aforementioned reference in Chapter 4.

As explained above, the distances $l_n$ can be expressed as a transcendental function of two polar angles $\phi_{n-1}$ and $\phi_n$. If the values of $l_n$ obtained above are substituted, there result a series of simultaneous equations for $\phi_n(n=1, \ldots)$ having a recurrence relationship which can be solved numerically by a computer. Alternatively, a computer-aided coordinatorgraph can easily and accurately draw a desired two-arm Archimedean spiral with the low pass filter sections incorporated into its arms. This drawing can be cut on a sheet of rubylith material and positive and/or negative photographs are made from the ruby so that photoetching of the spiral can be accomplished.

FIG. 1 shows such a spiral of diameter 11" etched from artwork drawn by a computer-aided coordinatorgraph.

Figure 3:
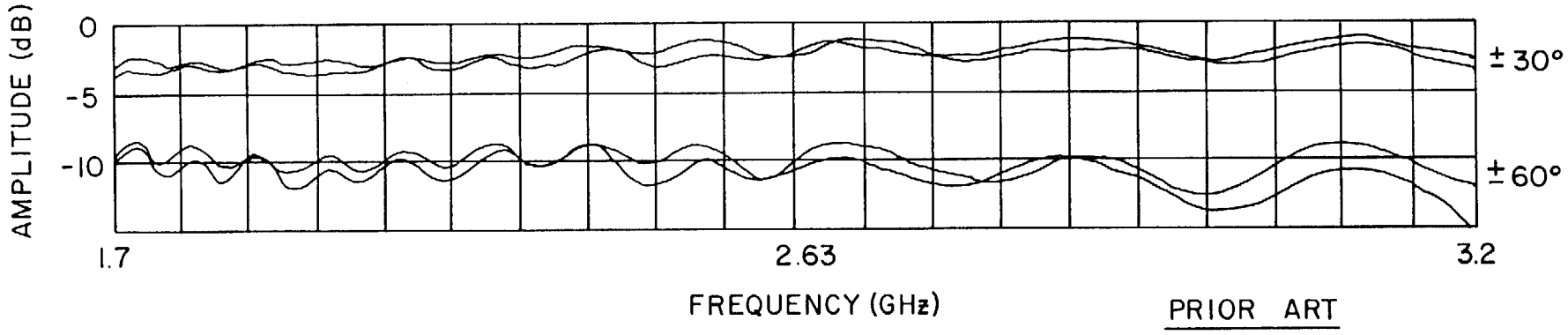
PRIOR ART FIG. — 3
FIG. 3 is a representative example of results of experiment with an antenna of a conventional design.

In order to investigate the effects of the present invention, a different Archimedean antenna of also 11" in diameter was used and the amplitude was measured. Reference was taken at antenna boresight for both horizontal and vertical polarization and the antenna was then rotated by predetermined angles from boresight and frequency was swept for each of these angles. FIG. 3 shows a typical example of results obtained when the angle of rotation was ±30° and ±60°, the direction of polarization was horizontal, and frequency was swept from 1.7 to 3.2 GHz. Amplitude is seen to vary sinusoidally as a function of frequency and this seems to substantiate the higher order mode radiation effect mentioned above. The peak of the sinusoidal variation indicates a broad beam and the null indicates a narrow beam. In other words, the antenna radiation pattern seems to "breathe". This phenomenon is caused by the rotation of the far field pattern about its axis and this pattern is a composite of the primary mode and third order mode variation. The phase relationship of these two modes are such that superposition of the two result in the far field radiation pattern of elliptic cross-secton. Phase rotation rates of these two modes are different and are frequency-dependent, inducing rotation of the ellipse with change in frequency.

Figure 4:
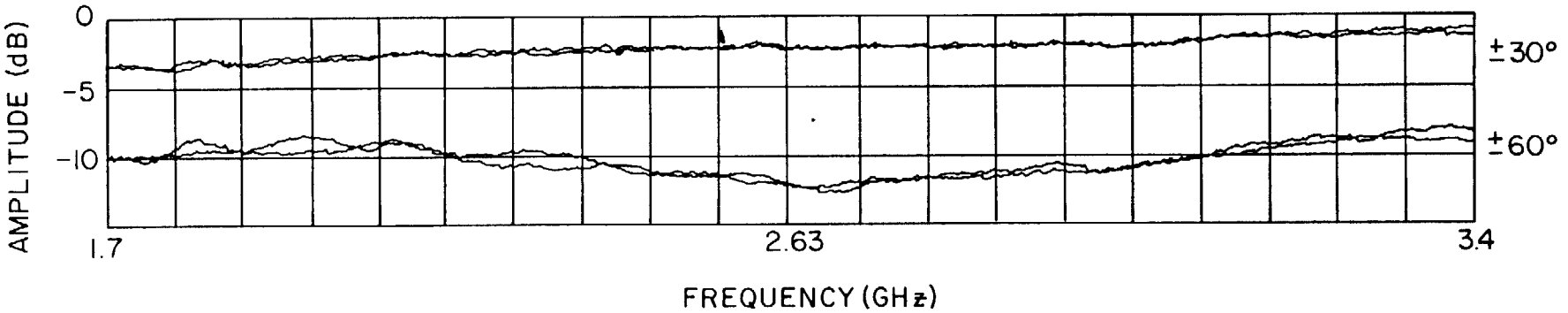
FIG. 4 shows the result of experiment with an antenna with the design of FIG. 1 in order to demonstrate the effects of this invention.

The effectiveness of the present invention is illustrated in FIG. 4 which shows the results of an experiment comparable to the one that produced FIG. 3. For this experiment, the 11" diameter spiral of the design shown in FIG. 1 was used to measure the amplitude under the same conditions as those for FIG. 3. A Marchand balun was used to feed an absorber-filled cavity-backed spiral. Comparison of FIGS. 3 and 4 clearly shows that the effect of the higher order radiation is virtually eliminated.

There is still some change in beamwidths from 500 MHz to 3.2 GHz, but the change is gradual. With the proper number of elements and spacing between field sections, the beamwidths change can be eliminated. In summary, it is clearly demonstrated that the use of low pass filters as an integral part of a planar spiral is a viable method of improving antenna performance and, hence, an improvement in system capability.

This invention was described above in terms of only one embodiment. The above description, however, is to be considered as illustrative rather than as limiting, and this invention is accordingly to be broadly construed. For example, the spiral antennas of this invention are not limited to be planer or Archimedean. The principle upon which this invention is based can also be applied to equiangular spiral antennas as well as conically configured antennas. The scope of this invention is defined by the following claims.

What is claimed is:

1. A spiral antenna comprising two elongated antenna arms each extending outwardly and spiraling about an axis, each said antenna arm having an innermost end and an outermost end, each said antenna arm further having broad sections and narrow sections alternately from said innermost end to said outermost end such that said antenna arms with said broad and narrow sections form a series of filter means each blocking energy progressively at higher frequency, the nth of said sections from said innermost end along each said antenna arm having a length given approximately by $(V_h/\omega_i)\sin^{-1}(Z_lg_n/Z_h)$ if n is odd and $(V_lg_n/\omega_i)$ if n is even, where $Z_l/Z_h$ is the ratio of low-impedance to high-impedance sections of a Tchebyscheff filter, $V_l$ and $V_h$ are velocities of propagation along the low and high impedance lines of said filter, $\omega_i$ is the angular band edge frequency of said filter and $g_n$ are the known element values of said Tchebyscheff filter.

2. The antenna of claim 1 wherein said Tchebyscheff filter is of semi-lumped realization.

3. The antenna of claim 1 further comprising a feed-point at said innermost end.

4. The antenna of claim 1 wherein said Tchebyscheff filter is an equal ripple filter.

5. The antenna of claim 1 wherein said two antenna arms are in a symmetrical relationship with respect to said axis.

6. The antenna of claim 1 which is configured as a planar antenna.

7. The antenna of claim 1 wherein mutually adjacent ones of said broad and narrow sections have sharp boundaries therebetween.

8. The antenna of claim 1 wherein each of said sections has a uniform width.

* * * * *

UNITED STATES PATENT AND TRADEMARK OFFICE

CERTIFICATE OF CORRECTION

PATENT NO. : 4,725,848

DATED : February 16, 1988

INVENTOR(S) : Royden M. Honda

It is certified that error appears in the above-identified patent and that said Letters Patent is hereby corrected as shown below:

Insert Figures 3 and 4 as part of Letters Patent as shown on the attached sheet.

Signed and Sealed this

Tenth Day of October, 1989

*Attest:*

*Attesting Officer*

DONALD J. QUIGG

*Commissioner of Patents and Trademarks*